US009474316B2

(12) United States Patent
Berry

(10) Patent No.: US 9,474,316 B2
(45) Date of Patent: Oct. 25, 2016

(54) DUAL SHELL HELMET FOR MINIMIZING ROTATIONAL ACCELERATION

(71) Applicant: Bret Berry, Tallahassee, FL (US)

(72) Inventor: Bret Berry, Tallahassee, FL (US)

( * ) Notice: Subject to any disclaimer, the term of this patent is extended or adjusted under 35 U.S.C. 154(b) by 162 days.

(21) Appl. No.: 14/044,357

(22) Filed: Oct. 2, 2013

(65) Prior Publication Data

US 2015/0089722 A1 Apr. 2, 2015

(51) Int. Cl.
*A42B 3/00* (2006.01)
*A42B 3/06* (2006.01)

(52) U.S. Cl.
CPC ..... *A42B 3/064* (2013.01)

(58) Field of Classification Search
CPC ..... A42B 3/069; A42B 3/125; A42B 3/322; A42B 3/00; A42B 3/14; A42B 3/12; A42B 3/064
USPC ..... 2/6.8, 41–414, 6.81
See application file for complete search history.

(56) References Cited

U.S. PATENT DOCUMENTS

| | | | | |
|---|---|---|---|---|
| 6,560,787 | B2 | 5/2003 | Mendoza | |
| 6,658,671 | B1 | 12/2003 | von Holst | |
| 7,328,462 | B1 | 2/2008 | Straus | |
| 7,930,771 | B2 | 4/2011 | Delye | |
| 2005/0268383 | A1* | 12/2005 | Harris | A42B 3/121 2/413 |
| 2010/0186150 | A1* | 7/2010 | Ferrara et al. | 2/412 |
| 2012/0000008 | A1* | 1/2012 | Baldackin et al. | 2/410 |
| 2012/0017358 | A1* | 1/2012 | Princip et al. | 2/414 |
| 2012/0198604 | A1* | 8/2012 | Weber et al. | 2/414 |
| 2012/0297525 | A1 | 11/2012 | Bain | |
| 2013/0125294 | A1* | 5/2013 | Ferrara | 2/411 |
| 2013/0185837 | A1* | 7/2013 | Phipps | A42B 3/12 2/2.5 |

OTHER PUBLICATIONS

Kevin M. Guskiewicz, , et al., Biomechanics of Sport Concussion: Quest for the Elusive Injury Threshold. Exerc Sport Sci Rev. 2011;39(1):4-11.

King, Albert, et al., Is Head Injury Caused by Linear or Angular Acceleration? IRCOBI Conference—Lisbon (Portugal), Sep. 2003.

Rowson S, et al. Rotational head kinematics in football impacts: an injury risk function for concussion. Ann Biomed Eng. Jan. 2012;40(1):1-13. doi: 10.1007/s10439-011-0392-4. Epub Oct. 20, 2011.

Brittany Sauser, "Preventing Concussions" A new football helmet could help players avoid brain injuries, MIT Technology Review http://www.technologyreview.com/news/409516/preventing-concussions/ (Feb. 11, 2008).

OMNI-Directional Suspension; 6D Helmets ATR-1 Helmet Features; Advanced Impact Defense, http://www.6dhelmets.com/ 1 pg. Jan. 15, 2014.

OMNI-Directional Suspension; 6D Helmets ATR-1 Helmet Features; Advanced Impact Defense, http://www.6dhelmets.com/#!ods/c10b6; 2 pgs. Jan. 15, 2014.

* cited by examiner

*Primary Examiner* — Clinton T Ostrup
*Assistant Examiner* — Jillian K Pierorazio
(74) *Attorney, Agent, or Firm* — James M. Smedley LLC; James Michael Smedley, Esq.

(57) ABSTRACT

A protective helmet which employs an inner shell, an outer shell, and dampeners positioned between the inner and outer shells which facilitate rotational movement between the inner and outer shells. The dampeners also provide shock absorption to counter the rotational acceleration caused by an impact to the helmet.

20 Claims, 14 Drawing Sheets

DUAL SHELL HELMET FOR MINIMIZING ROTATIONAL ACCELERATION

FIELD OF INVENTION

The present invention relates to personal safety equipment for use by athletes, military personnel, motor sports participants and the like and in particular, protective headgear adapted to minimize rotational acceleration and/or axial compressive forces incident on the head of a wearer.

BACKGROUND

There are many professions and activities in which participants may be exposed to physical contact which may result in head injury. For example, athletes participating in contact sports, such as American football, are subject to exposure to concussions, hyperextension, whiplash-type head movement, and cervical compressive forces. Football players at positions such as interior lineman, for example, are subjected to physical contact on virtually every play which can force the player's head rapidly backward, to create a whiplash effect which can result in serious and disabling injury. Additionally, it has recently been noted that glancing blows, or hits not directly on center, lead to concussions as well as torsional neck injury. Moreover, persons involved in activities such as high speed vehicle test piloting and race car driving can also be exposed to hyperextension or whiplash-type injuries caused by high rates of acceleration and impact forces. Military personnel are likewise exposed to combat and training situations which place them at risk of head injury. For participants in these and other activities, protective headgear such as helmets is often standard equipment.

Most blows to the head of participants in such activities are not direct, on-axis impacts, which cause linear acceleration. Generally, the blows to the head are glancing blows, with the head of a participant twisting as a result. Recent studies have shown that concussions are likely most often caused by rotational acceleration of the head, i.e., combined linear and angular acceleration.

Currently, the solution to prevent or minimize these injuries has simply been to add more padding to existing helmets. Some designs have added "crumple zones" to the exterior of the helmet, or a padded cap. These existing designs do not prevent or minimize the effects of glancing or off-center impacts which result in rotational acceleration.

SUMMARY OF INVENTION

There is a need for protective headgear which may reduce the likelihood of certain head and neck injuries, such as concussion, whiplash, and hyperextension of the neck. The presently disclosed subject matter provide a helmet which offers improved protection against head and neck injury as a consequence of rotational acceleration upon impact.

In one aspect the presently disclosed subject matter relates to a protective helmet which employs an inner shell, an outer shell, and dampening elements positioned between the inner and outer shells which facilitate rotational movement between the inner and outer shells. The dampening elements, also referred to herein as dampeners, also provide shock absorption to counter the rotational acceleration caused by an impact to the helmet.

The inner shell includes an exterior surface and an interior surface which faces the head of a wearer. The exterior surface of the inner shell includes one or more dampeners that are formed and operable to interact with complementary dampeners included on the interior surface of the outer shell. In one embodiment, the complementary dampeners comprise essentially corresponding male dampener and female dampener elements. One skilled in the art will recognize that the male dampener element(s) may be disposed on either the inner shell outer surface or outer shell inner surface, and the corresponding female dampener element(s) may likewise be so disposed, as long as the male and female elements are disposed such that they are formed, situated and operable to interact with each other. Moreover, one or more male and female dampeners may be disposed on the same surface, as long as a counterpart female and male dampener is disposed on the opposite surface.

In one embodiment the inner shell may further include padding on its interior surface to cushion the wearer's head from direct blows and/or provide a comfortable and secure fit. Examples of such padding may include pads which are employed inside conventional, commercially-available helmets. The padding may be removable.

The dampeners may be any shape adequate to enable translational and rotational movement between the respective male and female dampeners. In one embodiment the female dampeners include a generally round opening formed therein for receiving the male dampener, which is generally cylindrical and sized to fit within the opening formed in the female dampener. The outer perimeter of the female dampener may have any suitable shape. When the inner shell is fitted in the outer shell, the male dampeners are situated in the opening of the female dampener. The male dampener is thus able to move translationally, as well as rotatably, within the female dampener.

The dampeners can be made from a variety of materials, such as elastic polymers, viscoelastic gels, magnetic material, etc. The dampeners can also be a combination of these materials. In further embodiments the dampeners may further include biasing elements such as springs, magnets, etc.

In some embodiments, there may be space between the outer perimeter of the male dampener and the inner perimeter of the female dampener.

In an embodiment in which the dampeners are polymers or gels, the dampeners may be in contact with each other along the perimeter of the male dampener and corresponding interior surface of the female dampener. In this embodiment the dampeners are operable to compress and elongate upon impact, permitting rotational and translational movement.

In embodiments employing magnetic dampeners, the male dampener may be a magnetic material and the female dampener may be a magnetic material having similar polarity, creating an opposing magnetic force, and a dampening effect.

The complementary male and female dampeners may include one or more biasing elements disposed between male and female dampeners. Those having skill in the art will recognize that the male and female dampeners may be engaged such that there is a gap formed between the outer perimeter of the male dampener and the inner perimeter of the female dampener. A biasing element may be disposed in the gap without being connected to either the male or female dampener; may be connected to one or the other of the dampeners; or be connected to both male and female dampeners. For example a spring may be anchored at each end to corresponding male and female dampeners. In another embodiment a biasing element such as a spring may be positioned in a gap between corresponding male and female dampeners but connected to only one, or neither, of the corresponding dampeners. Magnetic materials having substantially the same polarity may be disposed in, on or around corresponding, complementary dampeners creating an opposing magnetic force, and a biasing effect between the corresponding, complementary dampeners.

Furthermore, in embodiments in which there is no space between the perimeters of complementary dampeners, biasing elements may also be included. For example, a biasing element such as a spring may be disposed on the perimeter of one or both of the complementary, corresponding dampeners. Likewise, magnetic materials having substantially the same polarity may be disposed in, on or around corresponding, complementary dampeners creating an opposing magnetic force, and a biasing effect between the corresponding, complementary dampeners.

The inner and outer shells may be removably fitted together. Although in some embodiments the only connection between the inner and outer shell may be formed as a result of the male and female dampeners being in contact, the inner and outer shells may be further connected to each other so as to secure the inner shell to the outer shell while permitting rotational and translational movement upon impact. For example, complementary hook and loop fasteners, snaps, magnets etc. may be employed in regions of the shells such as along portions of the perimeter of the inner and outer shells. In other embodiments, the inner and outer shells may be engaged in close contact with each other via force-fit or the like.

When the outer surface of the outer shell of a helmet employing the disclosed subject matter sustains an impact force, the force of the impact causes the outer shell to move. The dampeners between the inner and outer shells absorb this energy, thereby reducing the amount of rotational acceleration transmitted to the inner shell. This energy may be further reduced by padding on the interior of the inner shell, thereby minimizing the amount of force transmitted to the wearer's head. After the impact has been absorbed, the dampeners return to their stable state, or rest position, thus realigning the inner and outer shells.

BRIEF DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION

The following is a detailed description of the invention provided to aid those skilled in the art in practicing the present invention. Those of ordinary skill in the art may make modifications and variations in the embodiments described herein without departing from the spirit or scope of the present invention. Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. All publications, patent applications, patents, figures and other references mentioned herein are expressly incorporated by reference in their entirety.

Figure 1:
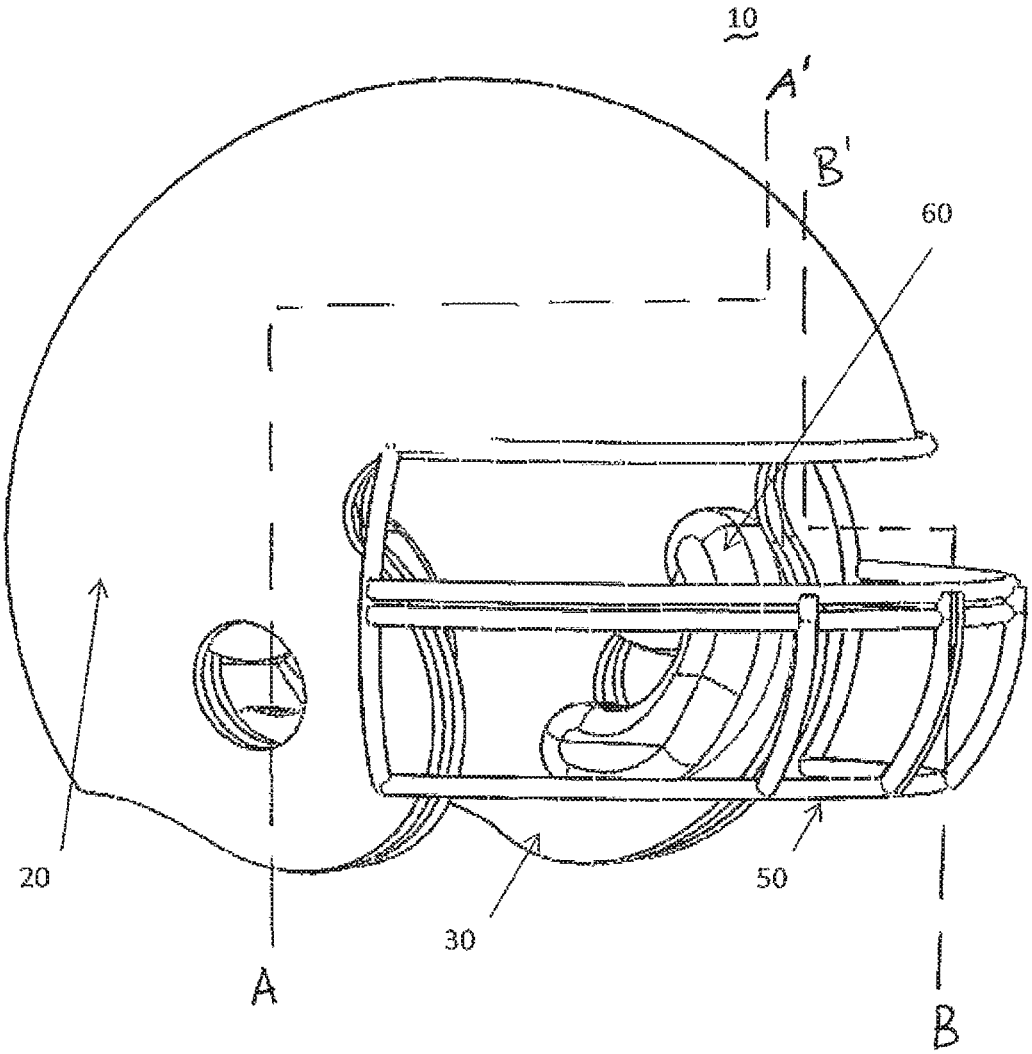
FIG. 1 is a front perspective view of a helmet in accordance with an embodiment of the present disclosure.

With reference to the drawings, wherein like numerals indicate like elements, there is shown in FIG. 1 a helmet 10 having an outer shell 20 and an inner shell 30. Helmet 10 may further include a facemask 50 and one or more pads 60 attached to the interior surface of the inner shell 30.

Outer shell 20 may be formed of any suitable material such as polycarbonate, carbon fiber, poly-paraphenylene terephthalamide (including KEVLAR® aramid fiber from DuPont), padded leather or synthetic material, etc. Inner shell may be formed of any suitable material such as polycarbonate, carbon fiber, poly-paraphenylene terephthalamide (including KEVLAR® aramid fiber from DuPont), leather, cloth, rubber, etc.

Pads 60 may be employed on the interior surface of inner shell 30 to cushion the wearer's head from direct blows and/or provide a comfortable and secure fit. Examples of suitable pads 60 include pads which are employed inside conventional, commercially-available helmets. Examples of suitable pad materials include plastic, foam, viscoelastic polymer, rubber, silicone, gel filled pads, air-filled or air fillable pads, etc. The pads 60 can be permanently attached or removable as is known in the art. Likewise, the pads 60 can be a singular pad system, or a system of pads manufactured from various different materials known in the art.

As will be recognized by those having ordinary skill in the art, facemask 50 may be any type of facemask suitable for the helmet 10. Facemask 50 is preferably attached to at least the outer shell 20 of helmet 10. Facemask 50 may be removable.

Figure 2:
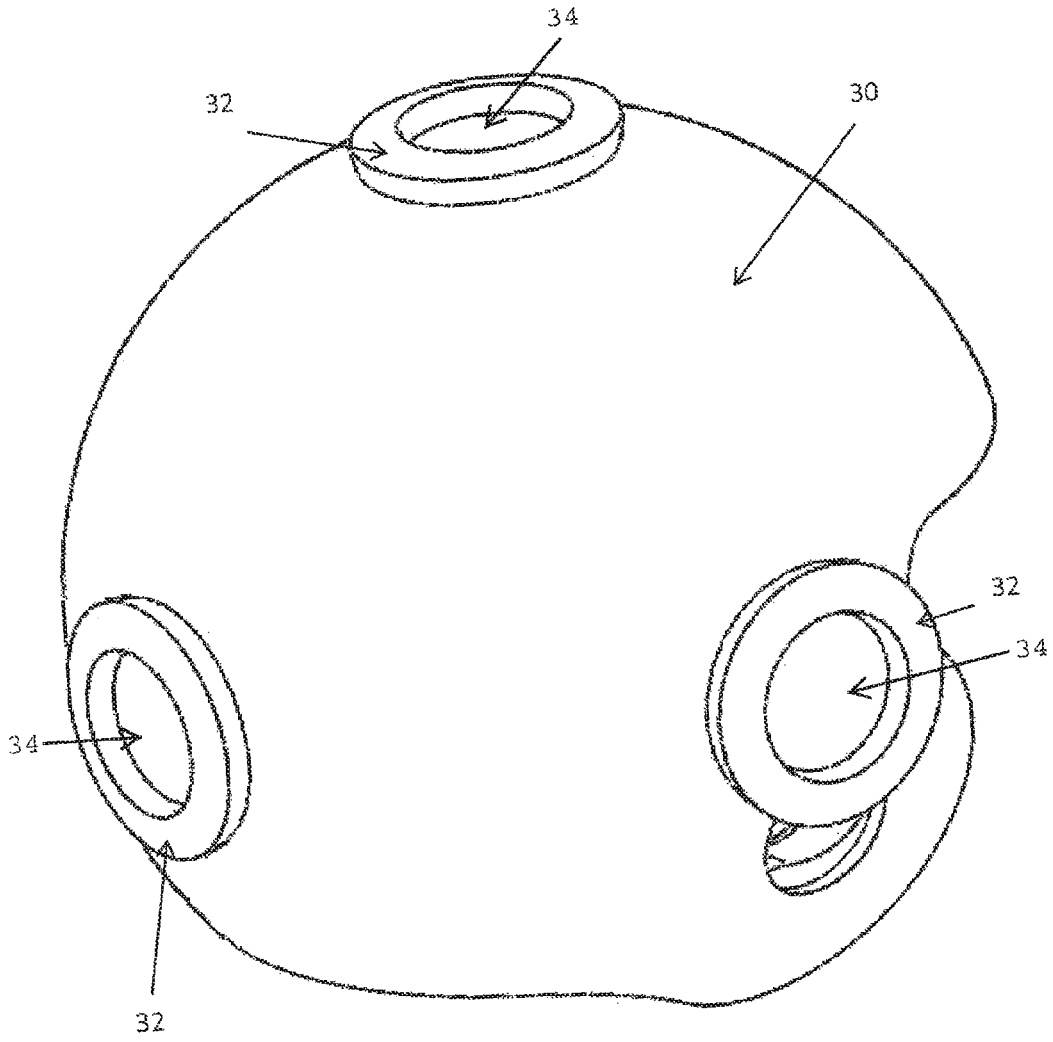
FIG. 2 is an elevated side perspective view of an inner shell of a helmet in accordance with an embodiment of the present disclosure.
Figure 3:
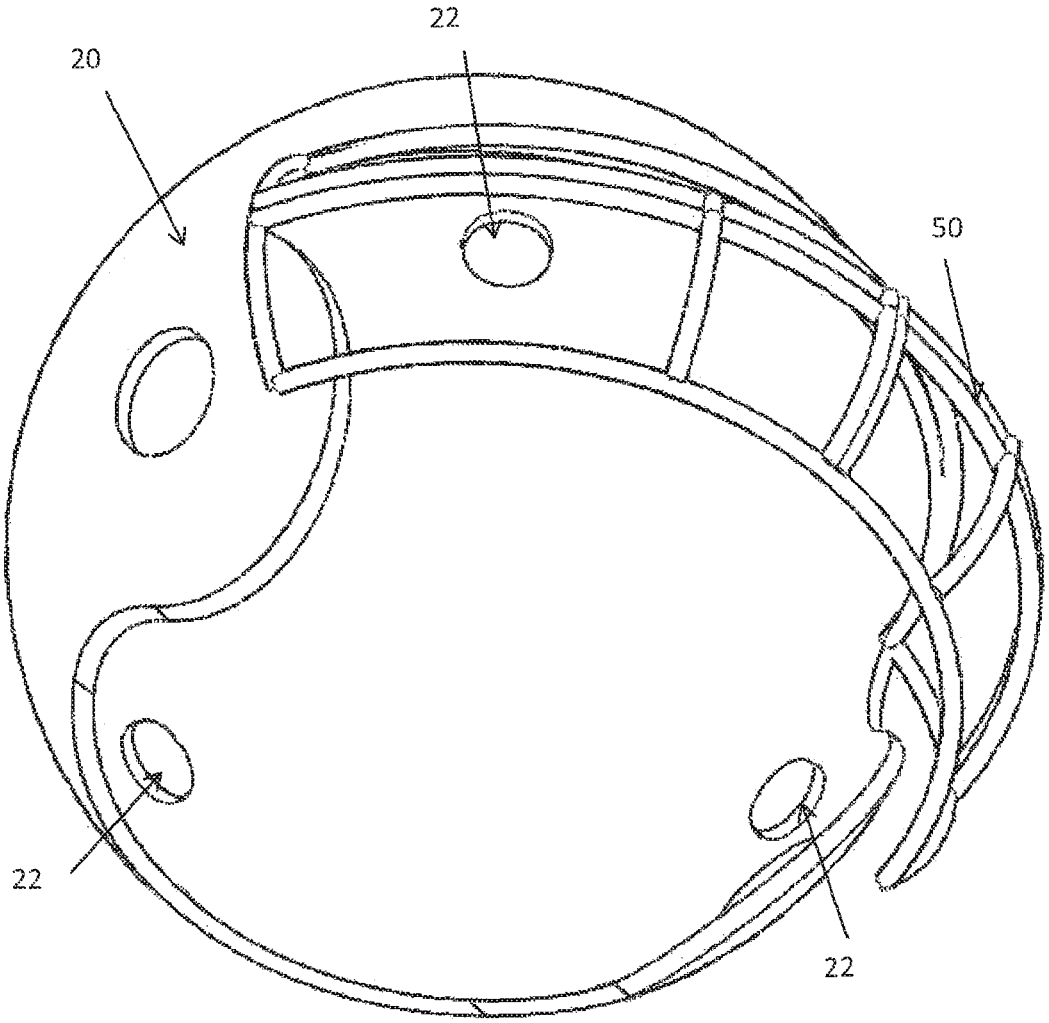
FIG. 3 is a bottom perspective view of an outer shell of a helmet in accordance with an embodiment of the present disclosure.

With further reference to FIGS. 2 and 3, in accordance with one embodiment, inner shell 30 includes female dampeners 32 arrayed on an exterior surface thereof and outer shell 20 includes male dampeners 22 arrayed on an interior surface thereof. In another embodiment, one or more female dampeners 32 may be arrayed on the interior surface of outer shell 20, and one or more male dampeners 22 may be arrayed on the exterior surface of the inner shell 30.

Figure 4:
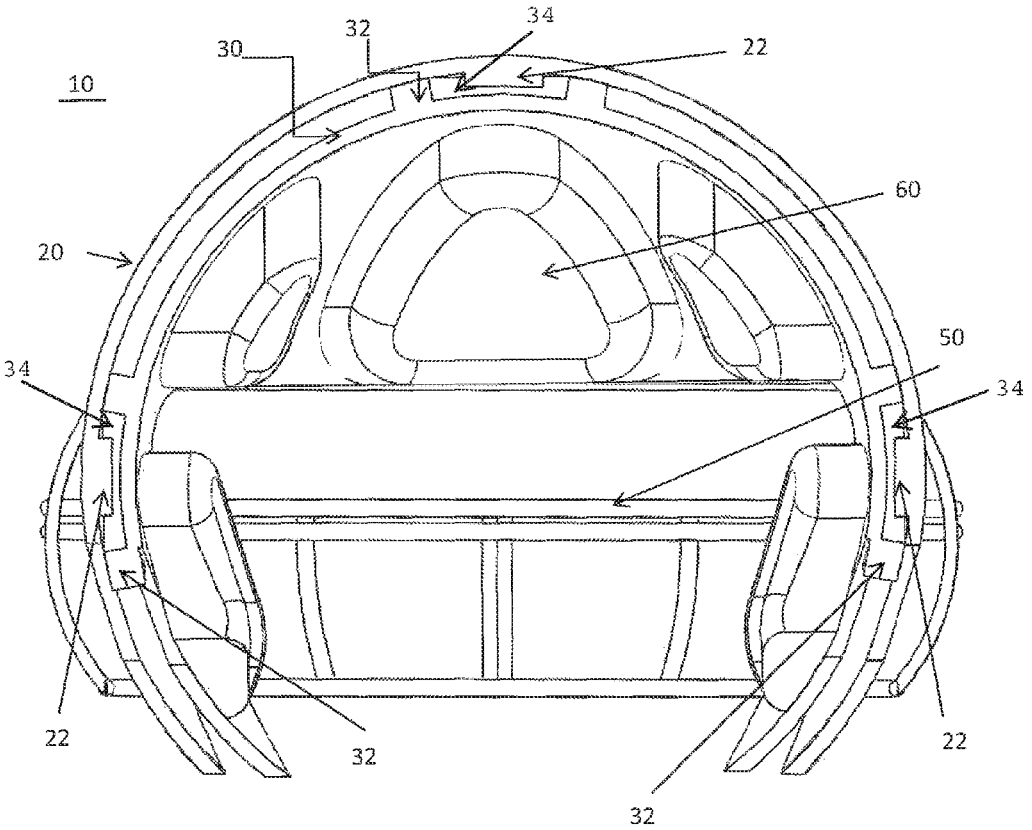
FIG. 4 is a cross-sectional view of the helmet according to FIG. 1 taken through line A-A'.
Figure 5:
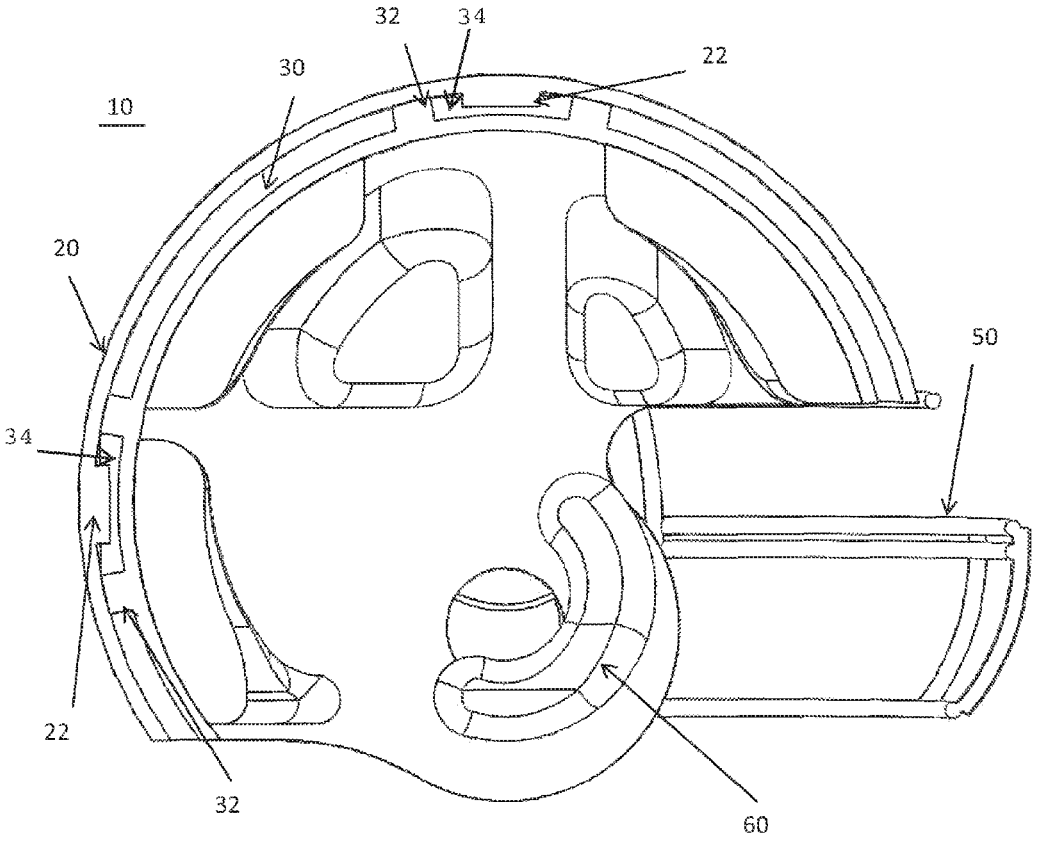
FIG. 5 is a cross-sectional view of the helmet according to FIG. 1 taken through line B-B'.
Figure 6:
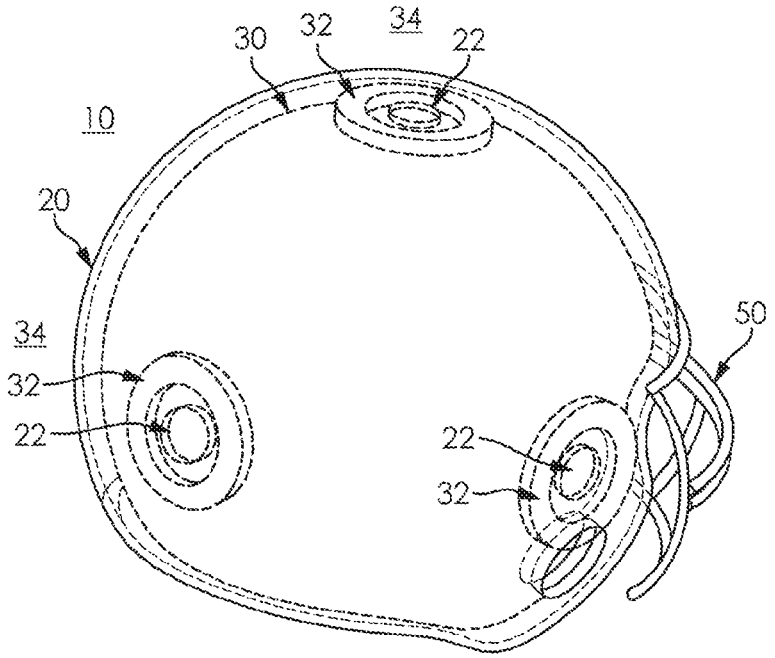
FIG. 6 is an elevated rear perspective view of a helmet in accordance with an embodiment of the present disclosure, in which dampeners and an inner shell are shown in phantom and the dampeners are depicted in a rest state.

Now referring to FIGS. 4-6, when the inner shell 30 is fitted in the outer shell 20, the male dampeners 22 are situated in an opening 34 formed in the female dampener 32. The male dampener 22 is thus able to move translationally, as well as rotatably, within the female dampener 32. The male dampeners 22 are formed and operable to interact with complementary female dampeners 32. Regardless of the shell (20 or 30) on which the dampeners 22, 32 are located, the male dampeners 22 and female dampeners 32 are disposed such that they are formed, situated and operable to interact with a corresponding, complementary dampener. It will be apparent to those skilled in the art that one or more male 22 and female 32 dampeners may be disposed on the same surface, as long as a counterpart female dampener 32 or male dampener 22 is disposed on the opposite surface.

While the female dampeners 32 are depicted as cylindrical elements having a round opening 34 formed therein, and the male dampeners 22 are depicted as generally cylindrical, the dampeners 22, 32 may be any shape adequate to enable translational and rotational movement between the respective male 22 and female 32 dampeners. As can be seen in FIGS. 4-6, the size of the male dampeners 22 relative to the female dampeners 32 is such that there is space between the outer perimeter of the male dampener 22 and the interior perimeter of the opening 34 of the female dampener 32 for accommodating rotational and translational movement therebetween, regardless of the perimeter shape of the male dampener 22 and/or the opening 34 of the female dampener 32. Accordingly, male dampener 22 may have any exterior perimeter shape, such as cylindrical, square, triangular, star, etc. The outer perimeter of the female dampener 32 may have any suitable shape. The perimeter of the opening 34 of the female dampener 32 may be any shape suitable to accommodating rotational and translational movement between the dampeners 22 and 32. In one embodiment the female dampener 32 includes a generally round opening 34 formed therein for receiving the male dampener 22.

The dampeners 22, 32 can be made of a variety of materials such as elastic polymers, viscoelastic gels, air-filled or air fillable structures, rubber, silicone, magnets, coils, etc. The dampeners 22, 32 can also be formed of a combination of these materials.

In some embodiments, for example in cases in which either or both of the dampeners 22, 32 are polymers or gels, the dampeners 22, 32 may be in full or partial contact with each other along the perimeter of the male dampener 22 and corresponding interior perimeter surface of the opening 34 of female dampener 32. In this embodiment the dampeners 22, 32 are operable to compress and elongate upon impact, permitting rotational and translational movement of the shells 20 and 30.

In some embodiments there may be space between the outside perimeter of the male dampener 32 and the inner perimeter surface of the female dampener.

When the outer surface of the outer shell 20 of a helmet 10 employing the disclosed subject matter sustains an impact force, the force of the impact causes the outer shell 20 to move. The dampeners 22, 32 between the inner shell 30 and outer shell 20 absorb this energy, thereby reducing the amount of rotational acceleration transmitted to the inner shell 30. This energy may be further reduced by padding 60 on the interior of the inner shell 30, thereby minimizing the amount of force transmitted to the wearer's head. After the impact has been absorbed, the dampeners 22, 32 return to their stable state, or rest position, thus realigning the inner and outer shells.

Figure 7:
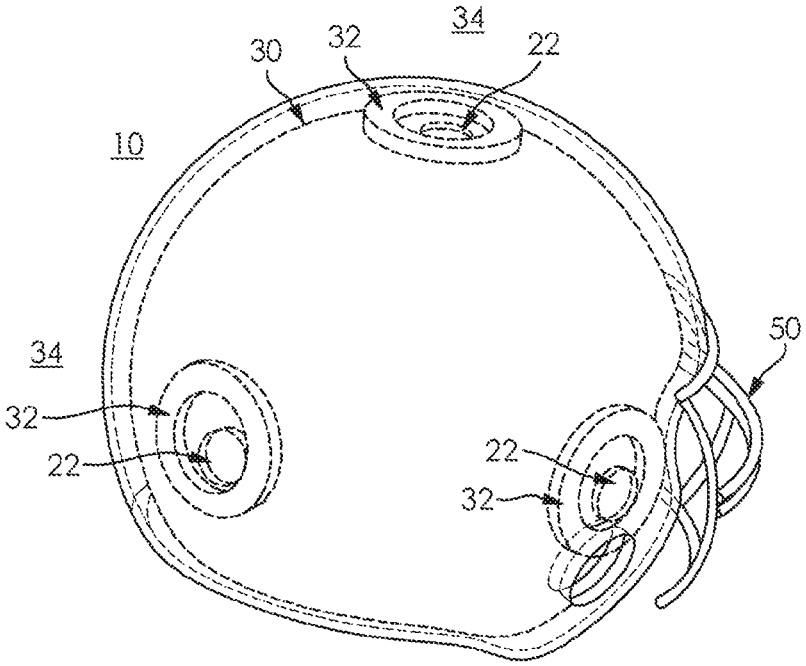
FIG. 7 is an elevated rear perspective view of a helmet in accordance with an embodiment of the present disclosure, in which dampeners and an inner shell are shown in phantom and the dampeners are depicted in a shifted state, demonstrating movement of the outer shell in relation to the inner shell.

With reference to FIG. 6, in accordance with one embodiment the outer shell 20 of helmet 10 is in its neutral, or rest, position in relation to the inner shell 30. The male dampeners 22 are substantially centered within the openings 34 of female dampeners 32. With further reference to FIG. 7, the outer shell 20 is shown in an absorption position in relation to the inner shell 30. The male dampeners 22 are not centered within the openings 34 of female dampeners 32. After impact, the dampeners 22, 32 work against each other to return the outer shell 20 to this neutral, or rest, position in relation to the inner shell 30. Impact forces are distributed on the sides of the complementary dampeners 22, 32. These forces are operable to return the dampeners 22, 32 to the rest position, and thereby the outer shell 20 is restored to the rest position. Furthermore, because the dampeners 22, 32 can absorb energy in all directions, axially, laterally, or rotationally, they can protect the wearer from a hit from any direction.

Now referring to FIGS. 8-11, in further embodiments, helmet 10 may include biasing elements 40. One skilled in the art will recognize biasing elements may be employed to maintain dampeners 22, 32 in a predetermined position, referred to herein as a rest or stable position, to restore dampeners 22, 32 to a rest position after movement due to impact, and/or control the velocity with which relative movement between the dampeners 22, 32 and shells 20 and 30 occurs. Examples of biasing elements 40 include coil springs, magnets, elastic bands, etc. The skilled artisan will recognize that the choice of biasing element 40 and the characteristics thereof will depend on the amount of elongation, deflection and restoring force desired for a particular application.

Figure 8:
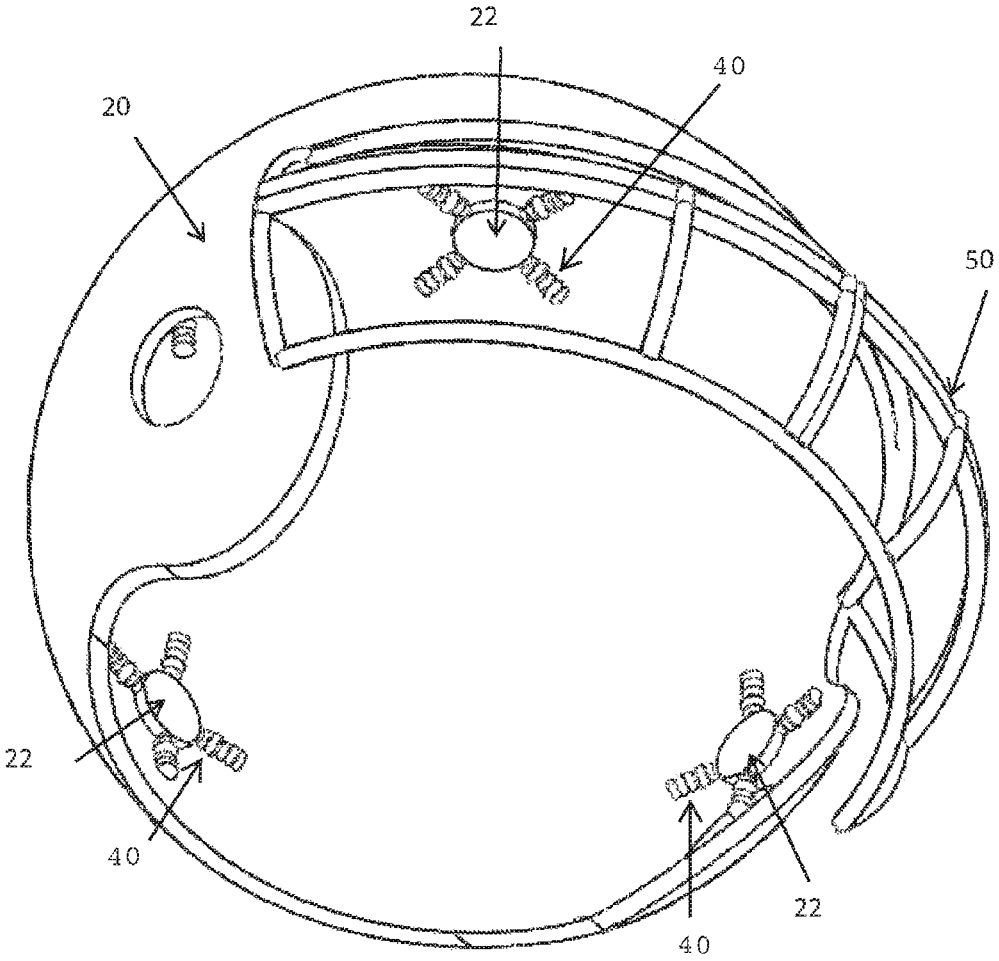
FIG. 8 is a bottom perspective view of an outer shell of a helmet in accordance with an embodiment of the present disclosure.

With reference to FIG. 8, biasing elements 40 may be positioned adjacent male dampener 22.

Figure 9:
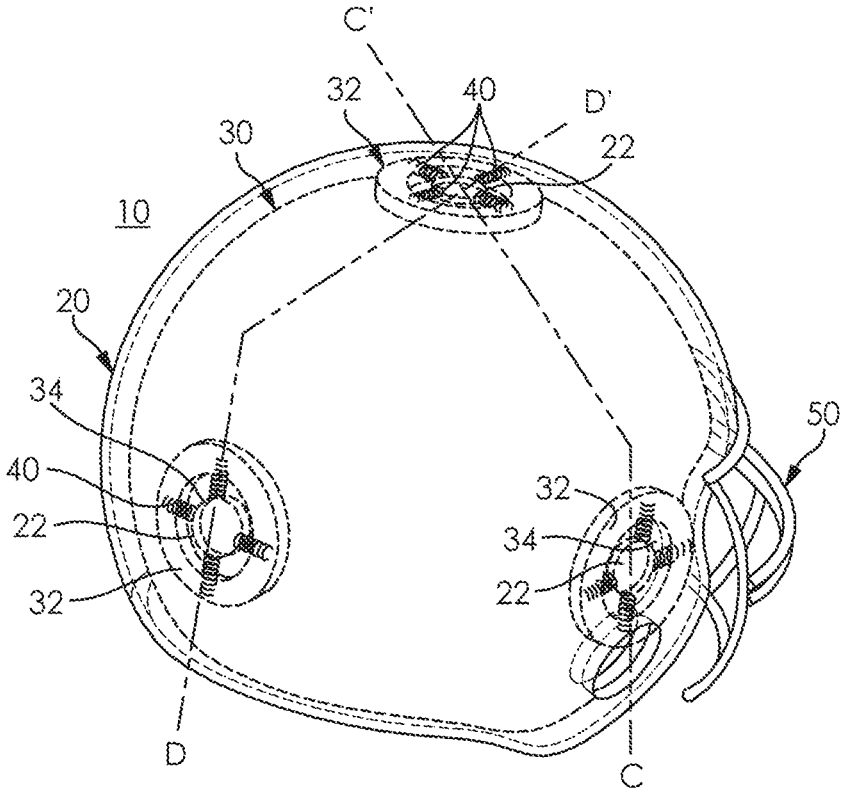
FIG. 9 is an elevated rear perspective view of a helmet in accordance with an embodiment of the present disclosure, in which dampeners and an inner shell are shown in phantom and the dampeners are depicted in a rest state.
Figure 10:
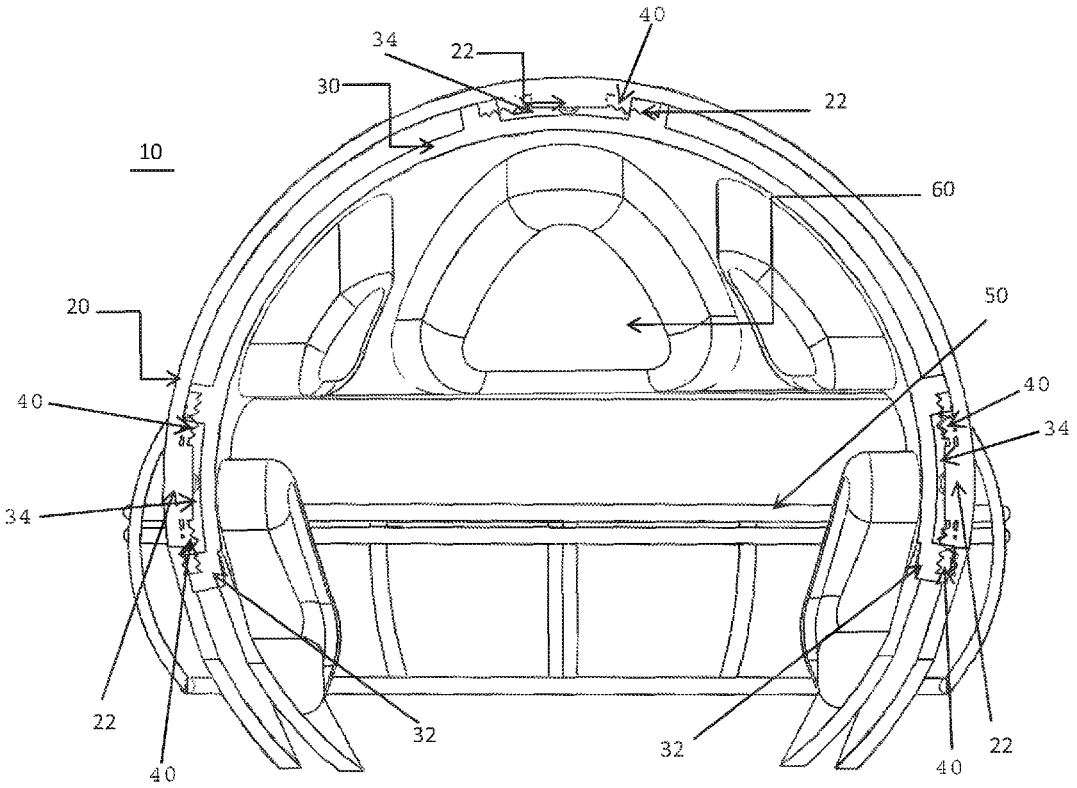
FIG. 10 is a cross-sectional view of the helmet according to FIG. 9 taken through line C-C'.
Figure 11:
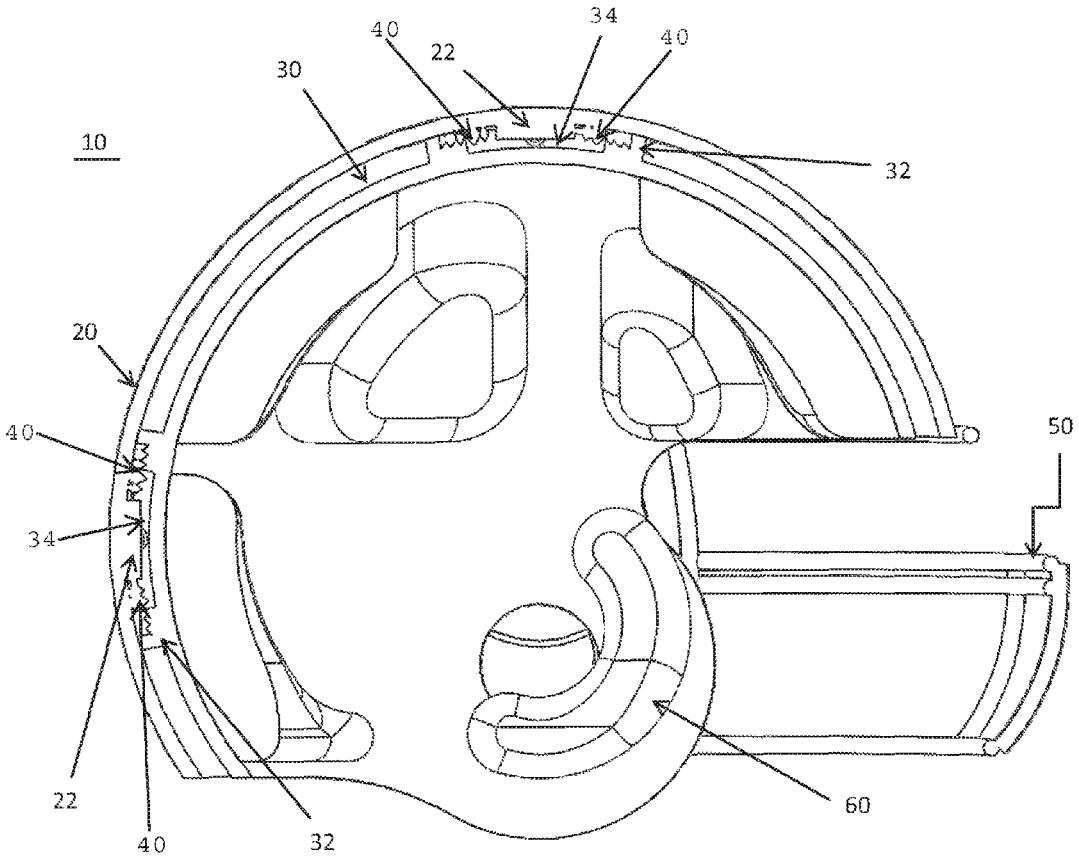
FIG. 11 is a cross-sectional view of the helmet according to FIG. 9 taken through line D-D'.

Now referring to FIGS. 9-11, in one embodiment biasing elements 40 are positioned between a male dampener 22 outer perimeter and female dampener 32 opening 34 interior perimeter.

In embodiments in which there is no space between the outside perimeter of the male dampener 22 and inside perimeter of the opening 34 of the female dampener 32, biasing elements 40 may also be included.

In embodiments employing magnetic dampeners 22, 32, the male dampener 22 may be a magnetic material and the female dampener 32 may be a magnetic material having similar polarity, creating an opposing magnetic force, and a dampening effect. In cases in which the dampeners 22, 32 are non-magnetic, magnetic biasing elements 40 may be employed in a similar fashion.

Figure 12:
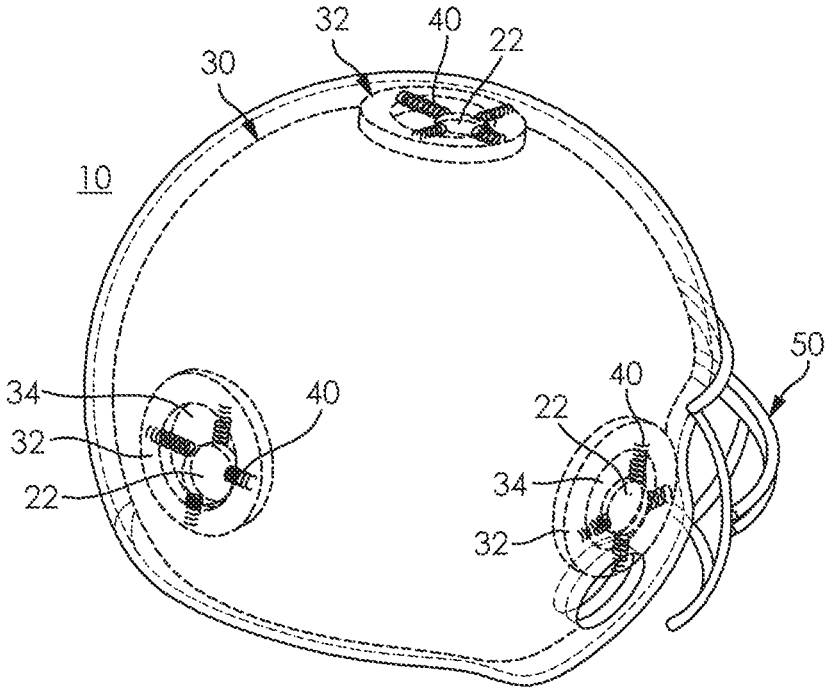
FIG. 12 is an elevated rear perspective view of a helmet in accordance with an embodiment of the present disclosure, in which dampeners and an inner shell are shown in phantom and the dampeners are depicted in a shifted state, demonstrating movement of the outer shell in relation to the inner shell.

With reference to FIGS. 9-11, the outer shell 20 is in its neutral position in relation to the inner shell 30. Male dampeners 22 are centered within openings 34 of female dampeners 32. As shown in FIG. 9, in one embodiment the biasing elements 40 disposed between the male dampeners 22 and female dampeners 32 are springs in a rest position and may be in substantially the same compression state. With reference to FIG. 12, the outer shell 20 is in an absorption position in relation to the inner shell 30, resulting in the biasing elements being energized. The male dampeners 22 are not centered within the openings of female dampeners 32. After each impact, the biasing elements 40 are energized and work against each other to restore the outer shell 20 to the rest position in relation to the inner shell 30. The arrangement of plural springs positioned between the dampeners 22, 32 provides forces which restore the dampeners 22, 32, and thereby the outer shell 20 to the rest position.

Figure 13:
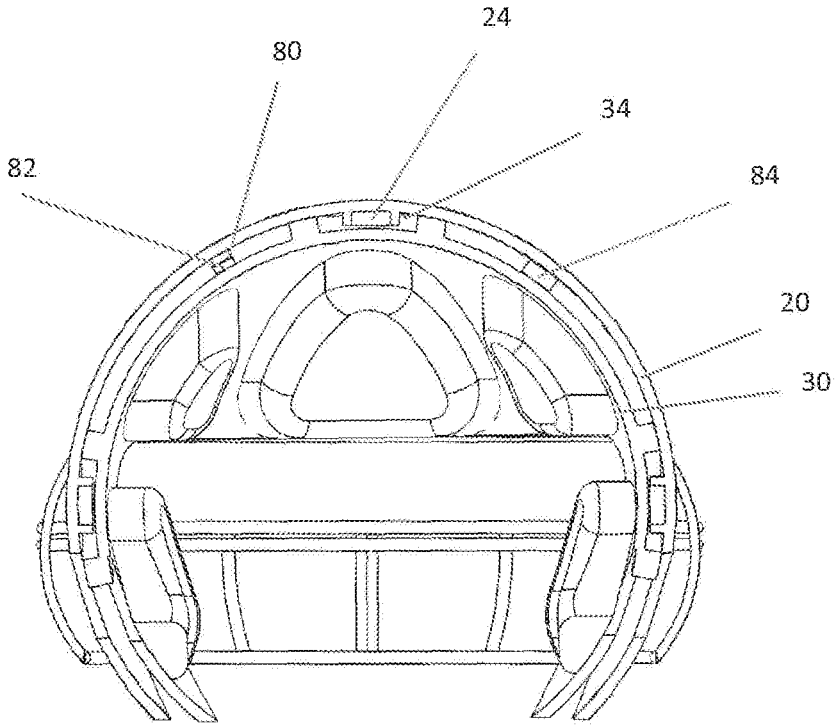
FIG. 13 is a cross-sectional view of an alternative embodiment of the helmet according to FIG. 1 taken through line A-A'.
Figure 14:
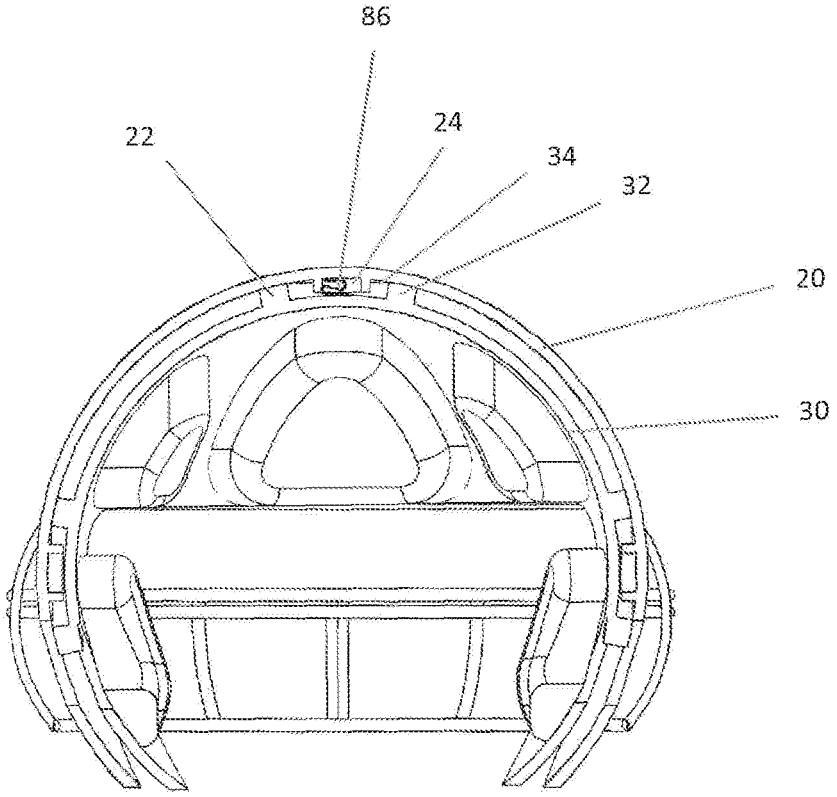
FIG. 14 is a cross-sectional view of an alternative embodiment of the helmet according to FIG. 1 taken through line A-A'.

As noted, the outer and inner shells 20, 30 may be removably fitted together. Although in some embodiments the only connection between the outer shell 20 and inner shell 30 may be formed as a result of the male and female dampeners 22, 32 being in contact with each other, or as a result of biasing elements 40 connecting the dampeners 22, 32, the outer and inner shells 20, 30 may be further connected to each other so as to secure the inner shell 30 to the outer shell 20 while permitting rotational and translational movement upon impact. For example, complementary snaps, magnets etc. may be employed in regions of the shells such as along portions of the perimeter of the outer and inner shells 20, 30. Now referring to FIG. 13, two embodiments of connectors are shown. In one aspect, magnets 80 and 82, having opposing polarity, are attached, respectively, to outer shell 20 and inner shell 30 and positioned so that they will connect when brought into close proximity with each other. One skilled in the art will recognize the magnets 80 and 82 (as well as other connectors) may be positioned in various locations in the helmet 10 to achieve the desired result. In another aspect, a web 84 is fixed at each opposing side, respectively, to outer shell 20 and inner shell 30. Web 84 may be any suitable material including fabric and/or polymer, or a block of foam or other suitable material. Now referring to FIG. 14, in one embodiment male dampener 22 may include an opening or recess 24 formed therein. A tether 86 may be permanently or removably fixed at one end to a region within an opening 34 in female dampener 32 and fixed at another end to an opening 24 formed in male dampener 22. The tether 86 may be formed of any suitable material well-known to those having ordinary skill in the art. For example, the tether 86 may be formed of a hook and loop fastener (including VELCRO® fastening material available from VELCRO USA® of Manchester, N.H.), whereby a strip of hook material extends from one shell surface and a strip of loop material extends from an opposing shell surface, the strips being located within the dampeners 22, 32 or outside the dampeners. In this manner the inner and outer shells 22, 32 may be removably fixed to each other. The tether 86 may also be permanently or removably fixed at each end to opposing shell surfaces outside the dampeners. In other embodiments, the outer and inner shells 20, 30 may be engaged in close contact with each other via force-fit or the like.

Figure 15:
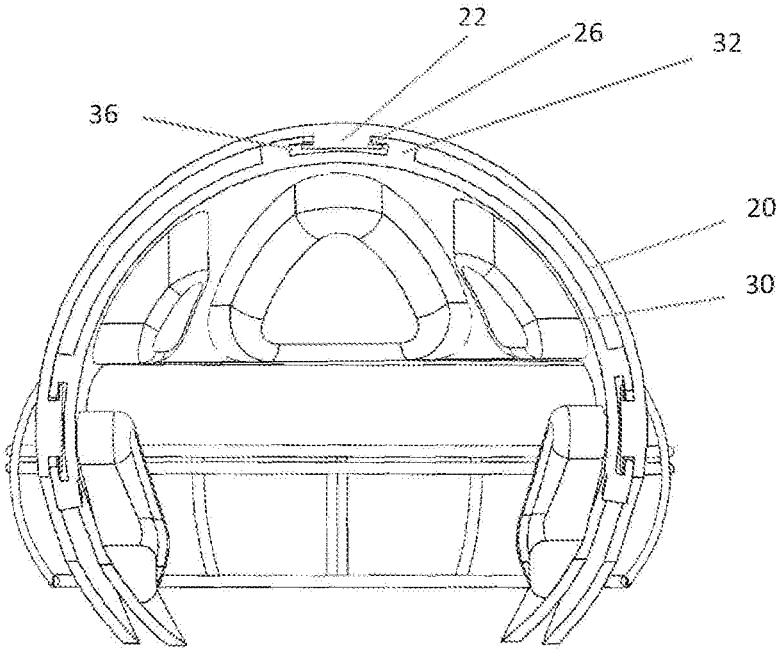
FIG. 15 is a cross-sectional view of an alternative embodiment of the helmet according to FIG. 1 taken through line A-A'.

Now referring to FIG. 15, in another embodiment male dampener 22 includes a rim 26 which is operable to engage a groove 36 formed in female dampener 32. The engagement of rim 26 and groove 36 permit rotational and translational movement between the inner and outer shells 22 and 32.

Although the systems and apparatus of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and apparatus may be made without departing from the spirit or scope of the present disclosure. Accordingly, such changes, modifications, enhancements and/or refinements are encompassed within the scope of the present invention.

What is claimed is:

1. A protective helmet comprising:

an outer shell having an exterior surface and an interior surface;

an inner shell having an exterior surface and an interior surface, wherein said inner shell is nested inside of and connected to said outer shell such that said interior surface of said outer shell and said exterior surface of said inner shell are opposing surfaces and said interior surface of said inner shell is conformed to fit over the head of a user; and dampening elements disposed between said inner and outer shells, wherein said dampening elements comprise disk-shaped male dampening elements attached to one of said opposing surfaces and disk-shaped female dampening elements attached to the other of said opposing surfaces, wherein each of said female dampening elements comprises an opening that is configured to receive and corresponds to one of said male dampening elements, thereby forming mated pairs of dampening elements between said inner and outer shells, which connect said inner and outer shells, wherein said mated pairs of dampening elements space apart said inner and outer shells, wherein at least one of said mated pairs of dampening elements comprises a compressible biasing element that biases said male dampening element of said mated pairs of dampening elements to a coaxial position in said female dampening of said mated pair of dampening elements, thereby biasing said outer shell towards a rest position relative to said inner shell, wherein said dampening elements are configured to move translationally and rotationally relative to one another, thereby enabling said outer shell to absorb the energy of an impact by converting said energy into at least one of rotational and compression energy, wherein during actual use of said helmet, said dampening elements absorb the energy from an impact to said helmet and reduce rotational acceleration that would otherwise be transmitted to the inner shell by said impact to said outer shell.

2. The protective helmet according to claim 1, further comprising at least one padding element attached to the interior surface of said inner shell, the padding formed and adapted to cushion a wearer's head.

3. The protective helmet according to claim 2, wherein the at least one padding element is removable.

4. The protective helmet according to claim 1, wherein the opening in said female dampening element is dimensioned to receive said male dampening element, such that the entirety of said male dampening element fits inside said opening.

5. The protective helmet according to claim 4, wherein a gap is defined between an outer circumference of the male dampening element and an interior rim of the female dampening element.

6. The protective helmet according to claim 4, wherein said male dampening element forms a tight fit inside said female dampening element, with no gap therebetween.

7. The protective helmet according to claim 1, wherein the dampeners are made of a material selected from the group consisting of: polymer, viscoelastic gel, and magnetic material.

8. The protective helmet according to claim 1, wherein the inner and outer shells are removably fitted together.

9. The protective helmet of claim 1, wherein said inner and outer shells are connected exclusively by way of said mated pairs of dampening elements.

10. The protective helmet of claim 1, wherein said outer shell is in a rest position when said male dampeners are centered concentrically in said female dampeners.

11. The protective helmet of claim 10, wherein said biasing element tends to move said male dampener back to a centered concentric position in said female dampener after they have been shifted out of said centered concentric position by a force applied to said outer shell.

12. The protective helmet of claim 1, wherein said male dampener element is tethered inside said female dampener element.

13. The protective helmet of claim 1, wherein said dampening elements combine to form three mated pairs of male and female dampening elements, wherein one of said mated pairs is positioned at a crown of said helmet, one mated pair is positioned in a rear of said helmet, and one mated pair is positioned on a side of said helmet.

14. The protective helmet of claim 1, wherein said mated pair of dampening elements is spring loaded.

15. A protective helmet comprising:

an outer shell having an exterior surface and an interior surface;

an inner shell having an exterior surface and an interior surface, wherein said inner shell is nested inside of and connected to said outer shell such that said interior surface of said outer shell and said exterior surface of said inner shell are opposing surfaces and said interior surface of said inner shell is conformed to fit over the head of a user; and dampening elements disposed between said inner and outer shells, wherein said dampening elements comprise male dampening elements attached to one of said opposing surfaces and female dampening elements attached to the other of said opposing surfaces, wherein each of said female dampening elements comprises an opening that is configured to receive and corresponds to one of said male dampening elements, thereby forming mated pairs of dampening elements between said inner and outer shells, which connect said inner and outer shells, wherein said mated pairs of dampening elements space apart said inner and outer shells, wherein at least one of said mated pairs of dampening elements comprises a plurality of springs collectively that bias said male dampening element of said mated pair of dampening elements to a centered concentric position inside said female dampening element of said mated pair of dampening elements, thereby biasing said outer shell towards a rest position relative to said inner shell, wherein said dampening elements are configured to move translationally and rotationally relative to one another, thereby enabling said outer shell to absorb the energy of an impact by converting said energy into at least one of rotational and compression energy, wherein during actual use of said helmet, said dampening elements absorb the energy from an impact to said helmet and reduce rotational acceleration that would otherwise be transmitted to the inner shell by said impact to said outer shell.

16. The protective helmet of claim 15, wherein said springs extend across a gap between an outer circumference of said male dampening element and an interior rim of said female dampening element.

17. The protective helmet of claim 15, wherein said plurality of springs are spaced apart and extend laterally from a circumferential surface of said male dampening member to engage an interior rim of said female dampening member.

18. The protective helmet of claim 17, wherein said springs are at least partly embedded in said female dampening member.

19. The protective helmet of claim 17, wherein said plurality of springs comprise a spring extending from each quadrant of said male dampening member.

20. A protective helmet comprising:

an outer shell having an exterior surface and an interior surface;

an inner shell having an exterior surface and an interior surface, wherein said inner shell is nested inside of and connected to said outer shell such that said interior surface of said outer shell and said exterior surface of said inner shell are opposing surfaces and said interior surface of said inner shell is conformed to fit over the head of a user; and dampening elements disposed between said inner and outer shells, wherein said dampening elements comprise male dampening elements attached to one of said opposing surfaces and female dampening elements attached to the other of said opposing surfaces, wherein each of said female dampening elements comprises an opening that is configured to receive and corresponds to one of said male dampening elements, thereby forming mated pairs of dampening elements between said inner and outer shells, which connect said inner and outer shells, wherein said mated pairs of dampening elements space apart said inner and outer shells, wherein at least one of said mated pairs of dampening elements comprises a compressible biasing element that uses a magnetic material to generate a magnetic force between said male dampening element of said mated pair of dampening elements and said female dampening element of said mated pair of dampening elements that biases said male dampening element of said mated pair of dampening elements to a coaxial position in said female dampening element of said mated pair of dampening elements, thereby biasing said outer shell towards a rest position relative to said inner shell, wherein said dampening elements are configured to move translationally and rotationally relative to one another, thereby enabling said outer shell to absorb the energy of an impact by converting said energy into at least one of rotational and compression energy, wherein during actual use of said helmet, said dampening elements absorb the energy from an impact to said helmet and reduce rotational acceleration that would otherwise be transmitted to the inner shell by said impact to said outer shell.

* * * * *